United States Patent [19]

Ingermann et al.

[11] Patent Number: 5,063,633

[45] Date of Patent: Nov. 12, 1991

[54] FLUID HANDLING APPARATUS FOR BOWLING LANE CLEANING DEVICE

[75] Inventors: Donald E. Ingermann, Arvada; Ronald L. Smith, Boulder; Stephen F. Caffrey, Arvada; Lonney J. Steinhoff, Evergreen, all of Colo.

[73] Assignee: Century International Corporation, Golden, Colo.

[21] Appl. No.: 471,507

[22] Filed: Jan. 29, 1990

Related U.S. Application Data

[63] Continuation-in-part of Ser. No. 371,295, Jun. 26, 1989, Pat. No. 4,920,604.

[51] Int. Cl.[5] ..... A47L 9/00

[52] U.S. Cl. ..... 15/320; 15/319; 15/340.2

[58] Field of Search ..... 15/320, 321, 302, 319, 15/340.2

[56] References Cited

U.S. PATENT DOCUMENTS

| | | | |
|---|---|---|---|
| 2,622,254 | 12/1952 | Mendelson | 15/320 X |
| 3,216,036 | 11/1965 | Rockwood et al. | 15/98 |
| 3,559,230 | 2/1971 | Ogle | 15/320 X |
| 4,151,627 | 5/1979 | Wisdom | 15/321 |
| 4,216,563 | 8/1980 | Cyphert | 15/321 |
| 4,369,544 | 1/1983 | Parisi | 15/320 |
| 4,724,573 | 2/1988 | Ostergaard | 15/321 |
| 4,809,397 | 3/1989 | Jacobs et al. | 15/320 |
| 4,856,138 | 8/1989 | Ingermann et al. | 15/320 |
| 4,920,604 | 5/1990 | Ingermann et al. | 15/302 |
| 4,937,911 | 7/1990 | Picchietti et al. | 15/320 |

*Primary Examiner*—Chris K. Moore

*Attorney, Agent, or Firm*—Fields, Lewis, Pittinger & Rost

[57] ABSTRACT

A vacuum bowling lane stripper is provided which has a carriage for movement along a bowling alley from a foul line to the pit. The carriage has a forward portion and a rear portion. A cleaning applicator is provided in the forward portion and a cleaner reservoir is provided in the rear portion. A conduit is provided for supplying cleaner from the reservoir to the applicator for applying cleaner to the bowling alley ahead of the carriage as the carriage is moved along the lane. A vacuum device is provided for removing cleaner and dirt from the surface of the lane, the vacuum device having a vacuum head extending transversely of the forward portion of the carriage and in an operative lane-engaging position.

11 Claims, 2 Drawing Sheets

FLUID HANDLING APPARATUS FOR BOWLING LANE CLEANING DEVICE

This application is a continuation-in-part application of our co-pending application U.S. Ser. No. 371,295, filed Jun. 26, 1989 for "Automatic Vacuum Bowling Lane Sweeper", now U.S. Pat. No. 4,920,604, issued May 1, 1990.

TECHNICAL FIELD

This invention relates to a bowling lane stripper and more particularly to an apparatus wherein separate containers are provided for liquid cleaner and waste cleaner which tanks are removably supported on a housing containing a pump for spraying the cleaner onto the lane and a vacuum motor for drawing the waste material from the lane into the waste tank.

BACKGROUND ART

U.S. Pat. No. 2,622,254 to Mendelson is directed to a carpet and/or floor cleaner, a hand powered device having a first tank mounted on the handle for supplying cleaner to the floor and a second tank on the handle to receive the waste fluid. The device has a carriage with means to apply cleaner to the floor, followed by rotating brushes, a squeegee and vacuum to pick-up waste fluid and a polishing roller. While adequate for its intended purpose, the waste tank must be unbolted from the handle for emptying or have a drain port for emptying into another container. Also, the operator must support the weight of the tanks on the handle when using the device, which can be tiring.

U.S. Pat. No. 3,216,036 to Rockwood et al. discloses a bowling lane cleaning device having a tank with conditioning fluid which is dispensed onto the bowling lane and applied by a buffer roller.

U.S Pat. No. 4,369,544 to Parisi discloses a machine to wash surfaces having a suction element in front, a front humidifier element, a sprayer and roller brushes, as well as a rear absorbing sheet and an intermediate dryer.

A bowling lane vacuum sweeper is disclosed in commonly assigned U.S. Pat. No. 4,856,138 to Ingermann et al. This device consists of a carriage extending laterally across the bowling lane and mounted on rollers for being manually pushed along the lane for removing cleaner and debris which has accumulated on the bowling alley. The device is provided with a floating vacuum head which sucks up the liquid cleaner and debris and deposits it in a tank which is provided within a housing containing the vacuum motor. In this device, the storage tank for the waste material is not removable but has a spigot which may be open so that the waste material can periodically be drained into a pail or other container for disposal. Although this device works satisfactorily for its intended, purpose it requires another device for applying the cleaner to the lane and the removal of the waste liquid is cumbersome and sometimes can be messy.

A device is disclosed in commonly assigned U.S. application Ser. No. 371,295, filed Jun. 26, 1989 for "Automatic Vacuum Bowling Lane Stripper" by Ingermann et al., now U.S. Pat. No. 4,920,604 which has an automatic device which applies a liquid cleaner to the bowling lane and has a vacuum head for immediately sucking up the cleaning liquid, oil and other debris contained in the cleaner after it has been deposited on the lane. This waste liquid is deposited into a removable waste tank in a housing which forms a major portion of the bowling lane stripper. Periodically, the tank can be removed from the housing and the liquid therein disposed of in a suitable manner. This apparatus is also satisfactory for its intended purpose, but does not lend itself well to use on a hand operated bowling lane cleaning device. Furthermore, the tank for supplying the cleaner is not removable. If it is desired to drain this tank it must be done by opening a spigot and collecting the cleaner in a pail or other separate container.

DISCLOSURE OF THE INVENTION

The present invention relates to a vacuum bowling lane stripper which has a carriage for movement along a bowling alley from a foul line to the pit. The carriage has a forward portion and a rear portion. A cleaning applicator means is provided in the forward portion and a cleaner reservoir is provided in the rear portion. Means is provided for supplying cleaner from the reservoir to the applicator means for applying cleaner to the bowling alley ahead of the carriage as the carriage is moved along the lane. A vacuum means is provided for removing cleaner and dirt from the surface of the lane, the vacuum means having a vacuum head extending transversely of the forward portion of the carriage and in an operative lane-engaging position.

More particularly, the carriage has rollers for supporting it for movement along a bowling lane, a rectangular box-like housing extends across the carriage and is removably supported thereon. A pump is mounted within the housing for pumping cleaner to the means for discharging the cleaner onto the bowling lane. A vacuum motor for drawing a vacuum at a vacuum head which is mounted in lane engaging position ahead of the carriage, is also mounted within the housing. A cleaner tank is supported on the housing above the pump for containing a supply of liquid cleaner. A first conduit means connects the pump in fluid communication with the cleaner tank. A second conduit means connects the pump in fluid communication with the discharging means so that the pump can pump cleaner from the cleaner tank to the discharge means for discharge onto the lane. A waste tank is removably supported on the housing above the vacuum motor for receiving waste liquid cleaner removed from the lane by the vacuum head. The waste tank has a side wall with an inlet and a bottom wall with an outlet in fluid communication with the vacuum motor. A baffle is provided within the waste tank adjacent the inlet to deflect air and waste cleaner downwardly. A tube extends upwardly from the bottom wall and has an open end above the highest expected liquid level in the waste tank facing away from the inlet through which air is drawn after the cleaner and other material is substantially separated therefrom. The open end of the tube has a screen covering it to further filter the air. A vacuum hose is connected between the vacuum head and the inlet so that waste fluid and air are drawn from the vacuum head into the waste tank and the air is discharged through the tube and the outlet.

The discharge means includes a plurality of sprayers mounted above the vacuum head. The cleaner tank and waste tank are configured so that the combined area and shape of the bottom walls of each is identical to the area and shape of the top wall of the housing. Furthermore, the top wall of the housing has a first recess for receiving a protruding portion of the bottom wall of the cleaner tank and the second recess of the top wall has a recess for receiving a protruding portion of the bottom wall of the waste tank so that both are held in a removably fixed position on the housing. Moreover, the cleaner tank and waste tank have contiguous sloping side walls wherein the side wall of the cleaner tank slopes outwardly toward the bottom and the side wall of the waste tank slopes inwardly toward the bottom so that the waste tank helps position the cleaner tank in position on the housing. With this arrangement, the waste tank can easily be removed for emptying.

Additional advantages of this invention will become apparent from the description which follows, taken in conjunction with the accompanying drawings.

BEST MODE FOR CARRYING OUT THE INVENTION

Figure 1:
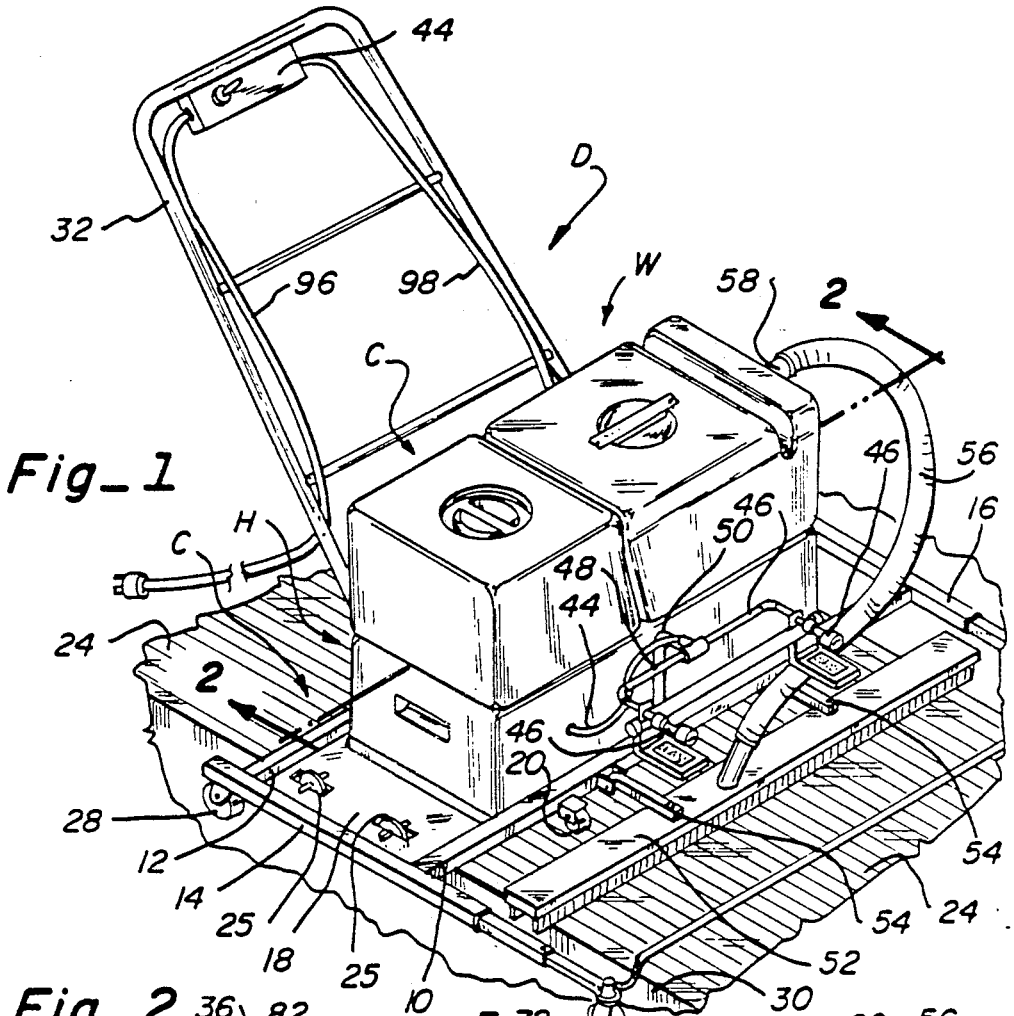
FIG. 1 is a perspective view of a bowling lane cleaning device including the fluid handling apparatus of this invention.
Figure 3:
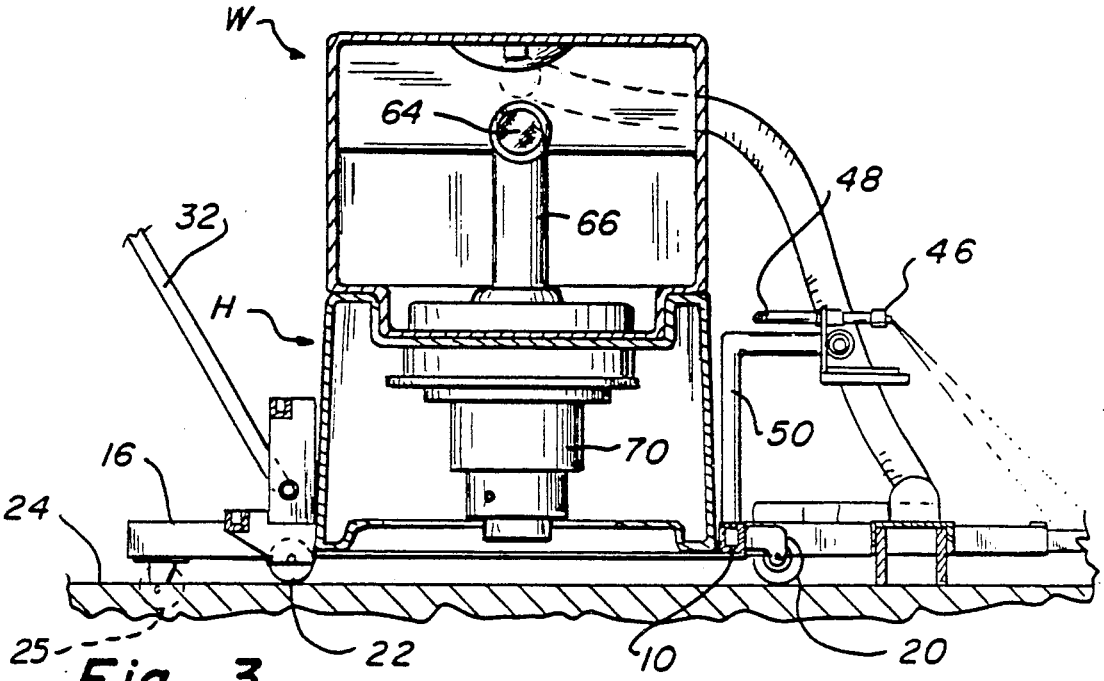
FIG. 3 is a vertical section, taken along line 3—3 of FIG. 2, showing additional details of the invention.
Figure 4:
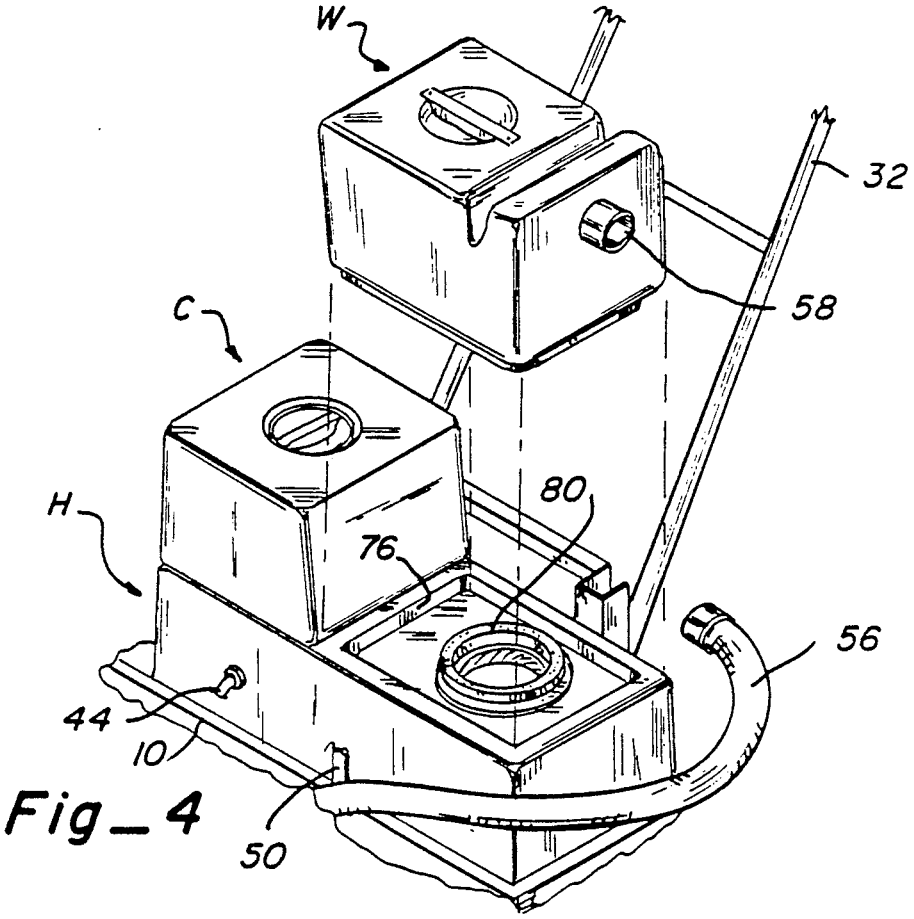
FIG. 4 is a perspective view showing the manner in which the waste tank is removed from the housing.

In accordance with this invention, a hand operated bowling lane cleaning device D is provided which includes a carriage C comprised of a pair of cross members, such as front cross member 10 and rear cross member 12, as best seen in FIG. 1. These cross members are interconnected by outboard frame members 14 and 16, respectively. Floor 18 extends between and is connected to all of these members for supporting housing H, as will be more fully described below. The carriage C is supported by a pair of spaced front rollers 20 and rear rollers 22, as best seen in FIG. 3, for movement along bowling lane 24. Side rollers 25 are provided along the edges of the gutter to guide device D therealong. Outboard rollers, such as rollers 26 and 28 are provided at opposite ends of outboard members 14 and 16, respectively, and are adapted to ride along the gutter 30. The carriage is pushed along the alley by means of handle 32.

Figure 2:
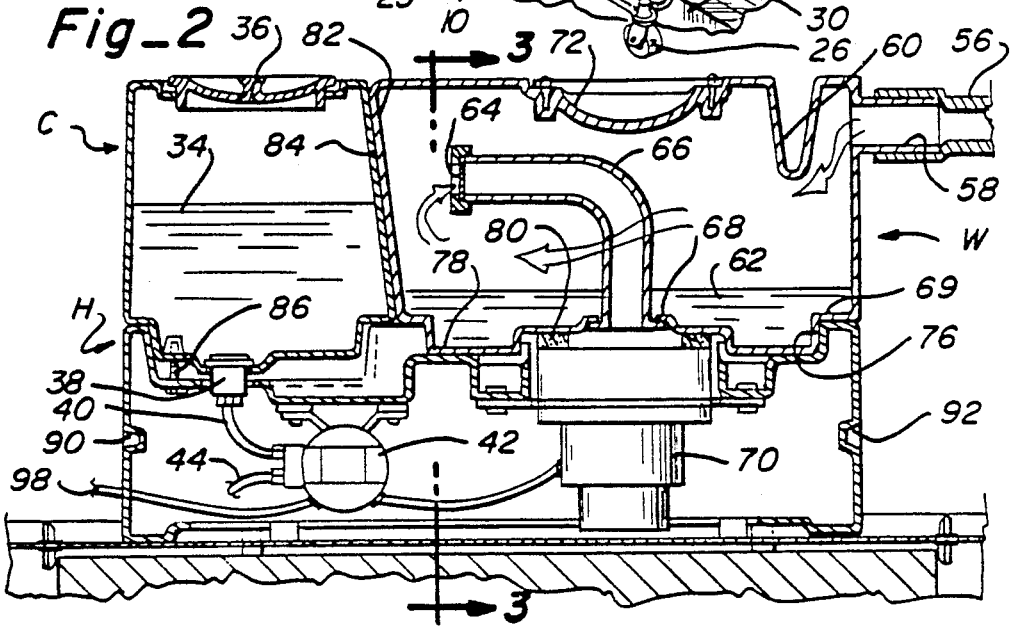
FIG. 2 is an enlarged horizontal section, taken along line 2—2 of FIG. 1, showing details of the cleaner tank and waste tank and the manner in which they are attached to the housing.

Mounted on housing H is a cleaner tank C which contains liquid cleaner 34, as shown in FIG. 2. The cleaner may be placed in tank C by removing cap 36 in the top wall thereof. The liquid passes through a drain 38 and via conduit 40 to pump 42 which supplies the cleaner under pressure through conduit 44 to sprayers 46 by means of pipes 48 mounted on a support 50 extending upwardly from cross member 50, as shown in FIGS. 1 and 3.

As the cleaning device D is moved forwardly along bowling lane 24, the liquid cleaner that has been deposited on the alley will dissolve and suspend the oil and dirt thereon so that it can be picked up by vacuum head 52 which is in lane-engaging position. The vacuum head is pivotally supported by a pair of spaced arms 54 attached to cross member 10. The vacuum head and support structure therefore are more clearly illustrated and described in the above-mentioned U.S. Pat. No. 4,856,138 for "Bowling Lane Vacuum With Floating Head".

The waste liquid is drawn through vacuum head 52 by vacuum hose 56 into an inlet 58 in the side wall of waste tank W. As best seen in FIG. 2, the incoming liquid and air strikes a baffle 60 molded in the top wall of waste tank W. This causes the waste liquid 62 to fall toward the bottom to cause substantial separation of the liquid and solids from the air. The air is then drawn through a screen 64 in an opening in the upper end of a curved tube 66, whose lower end is connected to an outlet 68 formed in the bottom wall 69 of waste tank W. The upper opening of tube 66 faces away from inlet 58 so that liquid and particles will be more likely to have separated from the air, which is slowed by baffle 60, and fallen to the bottom of the tank prior to reaching the tube. The air is then drawn through a vacuum motor 70 and discharged, as shown.

Conveniently, the top wall of waste container W has a recess 72 formed therein and a handle 74 attached thereto so that the waste container can be easily lifted off of housing H for dumping. Thus, when the waste container is substantially full, vacuum hose 56 will be disconnected from inlet 58 and handle 72 will be grasped by the operator and the waste tank W raised off of housing H. Advantageously, a recess 76 is formed in the top wall of housing H for receiving a protrusion 78 in the bottom wall of the waste tank which forms a secure fit for holding the waste tank on the housing. A seal ring 80 is provided on the upper end of vacuum motor 70 and engages a portion of the bottom wall of waste tank W to form a tight air seal. Advantageously, a side wall 82 of waste tank W slopes downwardly and inwardly, as seen in FIG. 2 and is contiguous with a similarly sloping side wall 84 of cleaner tank C which helps guide the waste tank into place when it is lowered onto housing H.

As can best be seen in FIG. 2, the cleaner tank is held in place by a plurality of bolts, such as bolt 86 shown in FIG. 2. Under normal operation, there would be no reason to remove cleaning tank C from housing H.

Housing H is provided with a pair of recesses 90 and 92 in opposite end walls to provide handles to assist in removing the housing from the carriage.

To operate the device, a control switch 94 is provided on handle 32 which is connected to a source of power through electrical conduit 96. When switch 94 is closed, pump motor 42 and vacuum motor 70 are activated by current supplied through wire 98.

From the foregoing, it can be seen that a bowling lane cleaning device has been provided wherein a modular cleaning tank and a modular waste tank can be easily positioned upon and removed from a modular housing which contains the pumps and motors for supplying cleaning fluid to the bowling lane and for drawing a vacuum for removing waste material from the lane. The waste tank W can be easily removed from the housing and from the vacuum hose so that the liquid can be disposed of by dumping it through the outlet opening in a very convenient and sanitary manner.

This invention has been described in detail with reference to a particular embodiment thereof, but it will be understood that various other modifications can be effected within the spirit and scope of this invention.

What is claimed is:

1. A vacuum bowling lane stripper comprising:

a carriage for movement along a bowling alley from a foul line to the pit, said carriage having a forward portion and a rear portion;

cleaner applicator means in said forward portion;

a cleaner reservoir;

means for supplying cleaner from said reservoir to said applicator means for applying cleaner to the bowling alley ahead of said carriage as said carriage is moved along the lane;

a vacuum means for removing cleaner and dirt from the surface of the lane, said vacuum means having a vacuum head extending transversely of said forward portion of said carriage and in an operative lane-engaging position said vacuum means further including a waste tank mounted in the rear portion of said carriage, said tank having a top, a bottom, spaced forward and rear side walls and spaced opposite end walls and having an inlet in one of said end walls and an outlet in said bottom wall;

a vacuum hose connected between said vacuum head and said inlet of said waste tank; and a vacuum motor connected to said outlet of said waste tank to draw a vacuum from said head through said vacuum hose and said waste tank.

2. Apparatus, as claimed in claim 1, wherein said waste tank includes:

internal baffle means to separate liquid and solid waste from a stream of air drawn through said vacuum means before it passes through said vacuum motor.

3. Apparatus, as claimed in claim 2, wherein said baffle means includes:

a first baffle spaced inside said inlet and extending downwardly from said top and across to each of said side walls for slowing said air stream down and directing it downwardly to enhance separation of the liquid and solids from the air stream.

4. Apparatus, as claimed in claim 3, wherein:

said inlet is located adjacent the top of said one end wall; and a curved neck is provided in said waste tank having one end connected to said outlet and extending upwardly so that the other end extends toward said other end wall.

5. Apparatus, as claimed in claim 1, wherein said waste tank has means for releasibly holding it within said carriage, said means including:

a rim extending downwardly from said bottom into supporting means on said carriage.

6. A vacuum bowling lane stripper comprising:

a carriage having rollers supporting it for movement along a bowling alley from a foul line to the pit;

a vacuum head extending transversely of said carriage and mounted forwardly thereof in a lane-engaging position for removing cleaner and dirt from the lane;

means for discharging cleaner onto the lane in front of said vacuum head to suspend any dirt and oil on the lane for removal by said vacuum head:

a rectangular box-like housing extending across said carriage and removably supported thereon;

a pump mounted within said housing for pumping cleaner to said discharging means;

a vacuum motor, for drawing a vacuum at said vacuum head, mounted within said housing;

a cleaner tank removably supported on said housing above said pump for containing a supply of liquid cleaner;

first conduit means connecting said pump in fluid communication with said cleaner tank;

second conduit means connecting said pump in fluid communication with said discharging means so that said pump can pump cleaner from said cleaner tank to said discharging means for discharge onto the lane;

a waste tank removably supported on said housing above said vacuum motor for receiving waste liquid cleaner removed from the lane by said vacuum head, said waste tank having a side wall with an inlet, a bottom wall with an outlet in fluid communication with said vacuum motor, a baffle within said waste tank adjacent said inlet to deflect air and waste cleaner downwardly, and a tube extending upwardly from said bottom wall and having an open end above the highest expected liquid level in said waste tank; and a vacuum hose connected between said vacuum head and said inlet so that waste fluid and air are drawn from said vacuum head into said waste tank and the air is discharged through said tube and said outlet.

7. Apparatus, as claimed in claim 6, wherein:

said open end of said tube is directed away from said inlet.

8. Apparatus, as claimed in claim 6, wherein said discharging means comprises:

a plurality of sprayers mounted above said vacuum head.

9. Apparatus, as claimed in claim 6, wherein:

said cleaner tank and said waste tank are configured so that the combined area and shape of the bottom walls of each is identical to the area and shape of the top wall of said housing.

10. Apparatus, as claimed in claim 9, further including:

a first recess in said top wall of said housing for receiving a protruding portion of said bottom wall of said cleaner tank to hold said cleaner tank in a removable fixed position on said housing; and a second recess in said top wall of said housing for receiving a protruding portion of said bottom wall of said waste tank to hold said waste tank in a removably fixed position on said housing.

11. Apparatus, as claimed in claim 9, wherein:

said cleaner tank and said waste tank have contiguous sloping side walls wherein said side wall of said cleaner tank slopes outwardly toward the bottom and said side wall of said waste tank slopes inwardly toward the bottom so that said waste tank holds said cleaner tank in position on said housing until said waste tank is first lifted from said housing.

* * * * *